US006438880B2

(12) United States Patent
Dundorf

(10) Patent No.: US 6,438,880 B2
(45) **Date of Patent: *Aug. 27, 2002**

(54) WEATHER-PROOF READERBOARD SIGNAGE SYSTEM

(76) Inventor: David M. Dundorf, 426 Foresyth Rd., Salem, CT (US) 06420

( * ) Notice: Subject to any disclaimer, the term of this patent is extended or adjusted under 35 U.S.C. 154(b) by 0 days.

This patent is subject to a terminal disclaimer.

(21) Appl. No.: 09/749,242

(22) Filed: Dec. 27, 2000

Related U.S. Application Data

(63) Continuation of application No. 08/986,395, filed on Dec. 8, 1997, now Pat. No. 6,178,679, which is a continuation-in-part of application No. 08/600,609, filed on Feb. 13, 1996, now abandoned.

(51) Int. Cl.[7] ..... G09F 7/02

(52) U.S. Cl. ..... 40/618; 40/5; 40/611

(58) Field of Search ..... 40/5, 210, 576, 40/611, 618, 620, 640, 651, 661.03, 661.11

(56) References Cited

U.S. PATENT DOCUMENTS

| | | | | | |
|---|---|---|---|---|---|
| 596,831 | A | * | 1/1898 | Roebuck | 40/618 |
| 1,203,712 | A | * | 11/1916 | Dietz | 40/618 |
| 2,540,718 | A | * | 2/1951 | Duskin | 40/618 X |
| 2,689,421 | A | * | 9/1954 | Lesniak et al. | 40/651 |
| 3,387,397 | A | * | 6/1968 | Buchanan et al. | 40/618 |
| 3,574,449 | A | | 4/1971 | Rosenberg | |
| 3,673,720 | A | | 7/1972 | Thornton | |
| 4,530,177 | A | | 7/1985 | Kane | |
| 4,682,430 | A | * | 7/1987 | Ramsey | 40/618 X |
| 4,924,611 | A | * | 5/1990 | Shaw | 40/210 |
| 5,088,221 | A | * | 2/1992 | Bussiere et al. | 40/618 |
| 6,178,679 | B1 | * | 1/2001 | Dundorf | 40/618 |

FOREIGN PATENT DOCUMENTS

| | | | | |
|---|---|---|---|---|
| WO | 7901032 | * | 11/1979 | 40/618 |

* cited by examiner

*Primary Examiner*—Brian K. Green
(74) *Attorney, Agent, or Firm*—Thomas J. Perkowski

(57) ABSTRACT

A weather-proof changeable-type readerboard signage system comprising a signboard having a substantially planar surface, and supportable above the Earth's surface at a predetermined viewing height. A pair of upper and lower character holding tracks are attached to the substantially planar surface of the signboard and extend in a parallel manner relative to each other by a predetermined distance. A plurality of character substrates of rectangular geometry, bearing a graphical character, and having a height dimension slightly less than the predetermined distance, are front loadable into the pair of upper and lower character holding tracks, and releasably retained therewithin so as to form a string of characters displaying a readable message. A character-protective viewing panel of optically transparent construction is slidably retained within the upper and lower character holding tracks in conjunction with the plurality of character substrates, so that the character-protective viewing panel is physically disposed over the plurality of character substrates and releasably secured to the signboard by one or more fastening elements passed through the character-protective viewing panel and secured into the signboard so as to prevent unauthorized removal of the character substrates from the upper and lower character holding tracks, while protecting the character substrates against mischief and vandalism, and natural elements presented in outdoor environments.

4 Claims, 6 Drawing Sheets

WEATHER-PROOF READERBOARD SIGNAGE SYSTEM

RELATED CASES

This is a continuation of application Ser. No. 08/986,395 filed Dec. 8, 1997, now U.S. Pat. No. 6,178,679, which is a Continuation-in-Part of application Ser. No. 08/600,609 filed Feb. 13, 1996, now abandoned, incorporated herein reference in its entirety.

BACKGROUND OF INVENTION

1. Field of Invention

The present invention relates to changeable (i.e. reader-board) type signage systems having novel viewing window that fully protects the changeable characters from the natural elements presented in outdoor environments such as rain, ice, snow, dirt, dust, grime and solar radiation, while providing a significant measure of protection from mischief and vandalism, without detracting from the utility and aesthetic appearance of such systems in diverse signage environments.

2. Brief Description of the State of the Art

For over a century, readerboard and messageboard signage systems have been well known in the signage art. In such signage systems, alphanumeric characters formed on thin rectangular substrates are held in place within a pair of parallel extending tracks, as illustrated in FIGS. 1 and 1A. Typically, the pair of character holding tracks 2 and 3 are mounted along a sign board 4 in spaced-apart and parallel extending manner. The function of the tracks is to hold a sequence of discrete characters 5 in place relative to each other in order that a desired message is displayed. In general, each character 5 comprises a rectangular shaped substrate upon which a symbol, such as an alphanumeric character, is realized by printing, adhesive attachment, or other means. Each character can be made from opaque or optically transparent material, depending on whether backlighting is to be employed in the construction of the signage system.

In the contemporary period, prior art reader-board signage systems are commercially available from various vendors. For example, Gemni Incorporated, of Cannon Falls, Minn. markets its PRONTO® brand Changeable Copy Reader-Board Letters and Numerals for use in its Changeable Message Systems and ReaderBoards. Wagner Zip-Change Inc. of Melrose Park, Ill. markets its ZIP-CHANGE® brand Flat Letters for use in its Changeable Message Systems and ReaderBoards. Change-Ad Letter Company, of Walnut, Calif. markets its Changeable Copy ReaderBoard Letters and Numerals for use in its Changeable Message Systems and ReaderBoards.

While prior art readerboard signage systems of the type described above have been useful in displaying public messages over the past century, such prior art signage systems have suffered greatly from a number of significant shortcomings and drawbacks.

In particular, the design of prior art readerboard signage systems have allowed ice and snow to enter the grooves of the tracks, rendering removal of the characters very difficult without damaging them. During the winter months, prior art readerboard signage systems are rendered virtually useless unless the entire signage system is enclosed within a viewing cabinet or case. Two prior art viewing case designs are shown in FIGS. 2A and 2B.

The readerboard casing design shown in FIG. 2A is essentially an viewing cabinet mounted over a conventional readerboard signage system. This type of readerboard viewing cabinet comprises a frame portion 6 mounted about a conventional readerboard, similar to the way a picture frame is mounted over a picture, and a viewing door 7 hingedly connected to the frame portion of the viewing cabinet by hinges 8A and 8B. As shown, the viewing door holds a panel of optically transparent glass or plexiglass 9 through which the message can be publicly viewed. Typically, the viewing door is secured shut by way of a conventional locking mechanism 10 to prevent unauthorized opening of the cabinet and reconfiguration of the signage characters. Prior art readerboard viewing cabinets of this type are disclosed in U.S. Pat. No. 1,203,712 incorporated herein by reference. As the length and height of each readerboard signage system will vary from site to site, the viewing cabinet must be custom designed to the size of the readerboard signage system under construction. In addition to detracting from the appearance of the signage system, this prior art readerboard system is very expensive to reduce to commercial practice. The only feasible way of practicing this type readerboard signage system, is to commercially produce a limited number of standard sizes from which customers are forced to choose. This renders it difficult to satisfy diverse customer requirements with only a small number of readerboard sizes. Also, The readerboard casing design shown in FIG. 2B is essentially a separate viewing cabinet 11, within which a conventional readerboard 12 is mounted. This type of cabinet comprises a frame portion to which the readerboard is mounted, and a viewing door hinged to the frame portion. The viewing door holds a panel of optically transparent glass or plexiglass through which the message can be publicly viewed. Typically, the viewing door is secured shut by way of a conventional locking mechanism to prevent unauthorized opening of the cabinet and reconfiguration of the signage characters. As the length and height of readerboard signage systems typically vary from site to site, this prior art viewing cabinet must also be custom designed to the size of the readerboard signage system under construction. Aside from detracting from the appearance of the signage system and adding to the overall cost thereof, this protective enclosure tends to retain enormous heat buildup causing the temperature therewithin to rise to significant levels within cabinet 11, warping the signage characters and adversely effecting the materials used to fabricate the same.

In addition to being highly vulnerable to outdoor weather, prior art readerboard signage systems can also be easily tampered with virtue of their inherently open track design. Thus, vandals or those disposed to mischief can easily slide or pull out one or more characters (i.e. letters and/or numerals) from the character holding tracks of such systems, and alter the message and thus meaning of the preconfigured message displayed from the system. In the case of a retail outlet, the result can be unauthorized advertising of a product for less than intended value. In other environments, lewd or indecent messages are spelled out, disrupting services and/or products being advertising.

Various prior art techniques have been developed in to prevent such forms of signage vandalism and mischief. One such technique, for example, is disclosed in Applicant's copending U.S. application Ser. No. 08/600,609 and shown in FIGS. 3A and 3B. As illustrated, this technique involves inserting a thin strip a narrow strip of plastic 8 into the top track 6, so that it rests on the top edges of all the characters 5 that form the message, while its end portion 14A is disposed against the left and right endmost characters and locked into place using tamper-proof screws 15A. While this technique prevents unauthorized front-unloading and end-unloading of message characters arranged with the tracks of readerboard signage systems, it fails to address the problems presented by outdoor environments such as rain, ice, snow, dirt, dust, and grime, which tend to work their way into the lower track and render removal of signage characters difficult, as well as deteriorate the material from which the characters are made.

Thus, there is a great need in the art for an improved readerboard signage system which overcomes the shortcomings and drawbacks of prior art systems.

OBJECTS AND SUMMARY OF THE PRESENT INVENTION

A primary object of the present invention is to provide a simple, yet inexpensive solution to the above-described problem while avoiding the problems associated with prior art signage systems.

A further object of the present invention is to provide such solution in the form of a readerboard signage system which allows the signage characters to be easily changed, while providing complete protection from the natural elements, such as ice, rain and snow, without increasing the physical dimensions of the readerboard signage system.

A further object of the present invention is to provide such solution in the form of a readerboard signage system which allows the signage characters to be easily changed, while providing a significant measure of protection from the natural elements, as well as mischievous behavior and vandalism.

A further object of the present invention is to provide a such a readerboard signage system, wherein the characters are held in place relative to each other by a pair of parallelly extending tracks and are locked in place relative to the tracks by a way of novel character protective viewing panel that prevents rain, ice and snow formations from rendering removal of the viewing panel and/or characters difficult in cold climates.

A further object of the present invention is to provide an improved readerboard signage system which is inexpensive to manufacture and easy to install and use.

A further object of the present invention is to provide an improved readerboard signage system which can be assembled using components that can standardized, stored in inventory, and readily adapted for construction of a signage system design according to the present invention with minimal working of the component materials.

Another object of the present invention is to provide such signage system, in which the character-protective viewing panel protects the letters from ultra-violet rays of sunlight.

Another object of the present invention is to provide such a signage system, which is completely compatible for use with letters from various vendors.

Another object of the present invention is to provide such a signage system, in which the configured message letters can be edge-illuminated.

These and other objects of the present invention will become apparent hereinafter and in the Claims to Invention.

BRIEF DESCRIPTION OF THE DRAWINGS

For a complete understanding of the objects of the present invention, the following Detailed Description of the Illustrative Embodiment should be read in conjunction with the following drawings, wherein.

DETAILED DESCRIPTION OF THE ILLUSTRATIVE EMBODIMENTS

Figure 1:
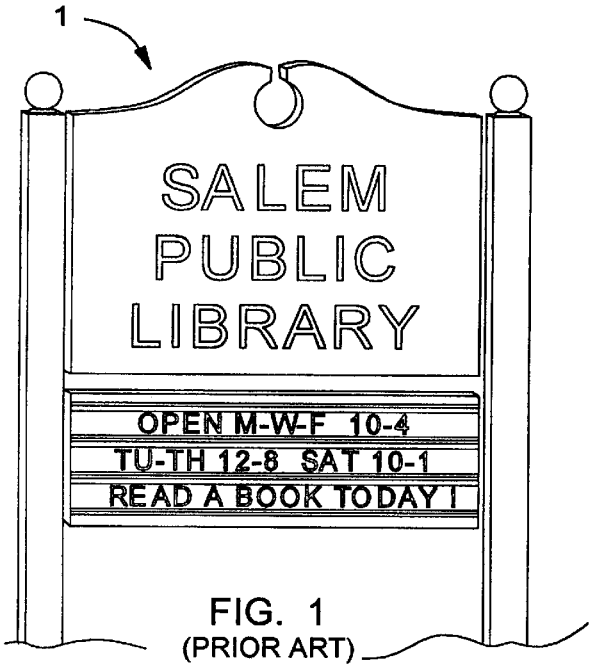
FIG. 1 (PRIOR ART)
FIG. 1 is a perspective view of a prior art changeable signage system to which the present invention is addressed.
Figure 1A:
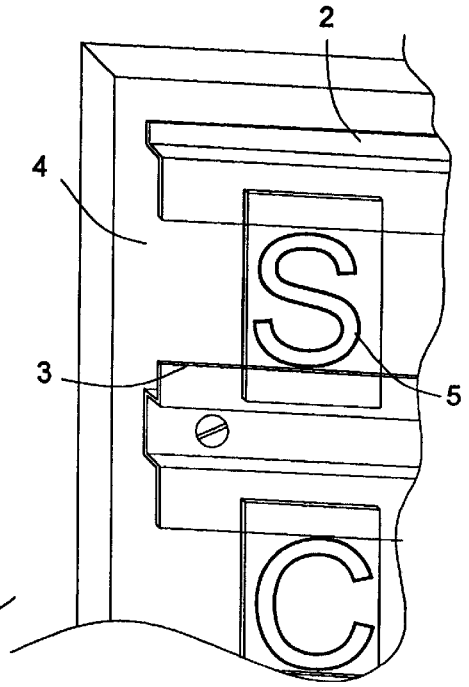
FIG. 1A (PRIOR ART)
FIG. 1A is a partially cut-away, close up view of the character holding track arrangement of the prior art changeable signage system of FIG. 1.
Figure 1B:
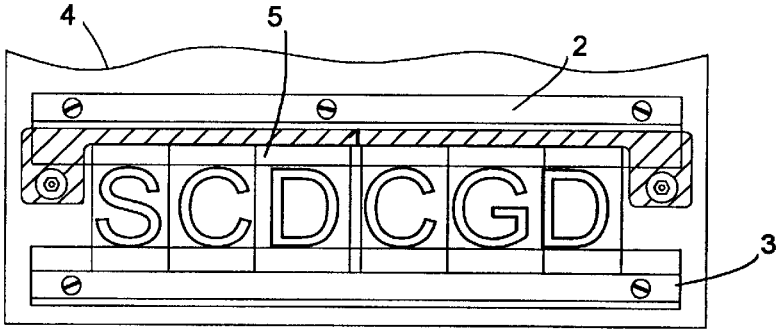
FIG. 1B is a perspective view of the changeable signage system, wherein the letters are locked into place using a strip placed between the top of the letters and the upper track of the system.
Figure 1C:
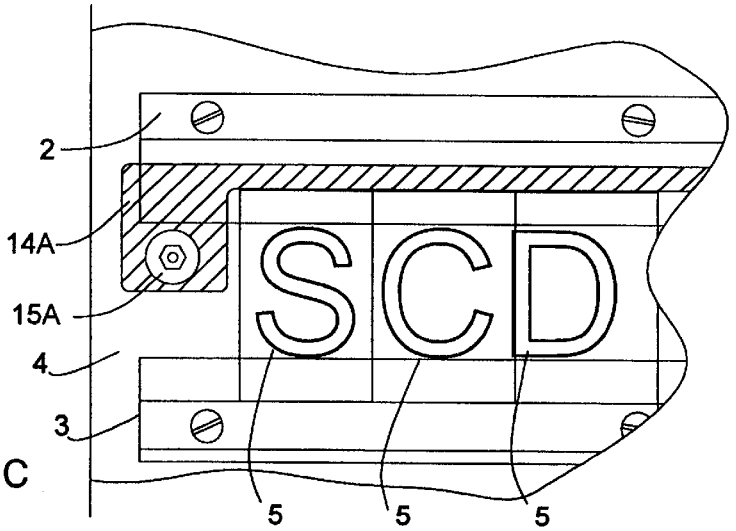
FIG. 1C is a partially cut-away, close up view of the character locking arrangement of the changeable signage system of FIG. 1B.
Figure 2B:
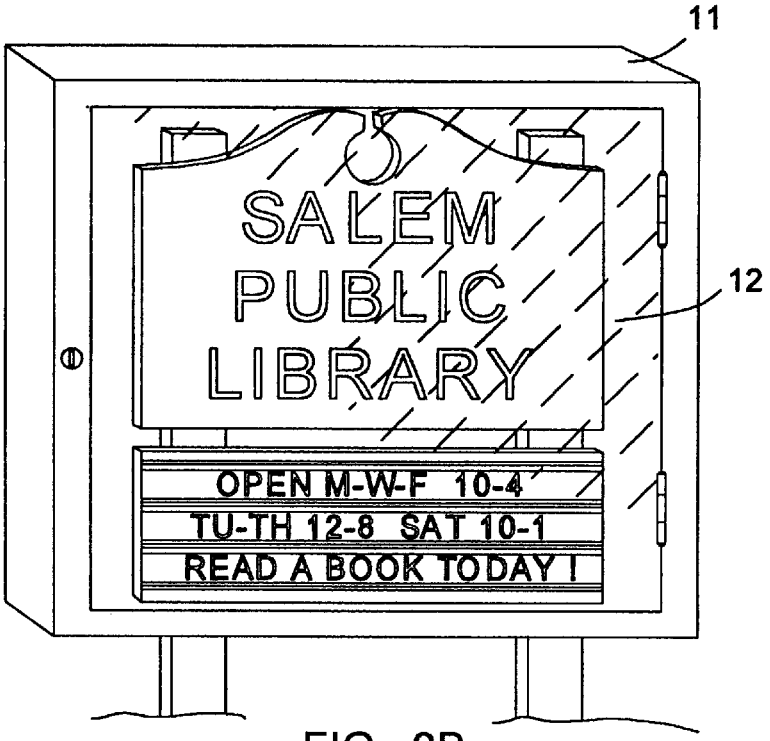
FIG. 2B (PRIOR ART)
FIG. 2B is a perspective view of a prior art signage system, in which a changeable signage system is encased behind a window frame having a transparent viewing window.
Figure 2A:
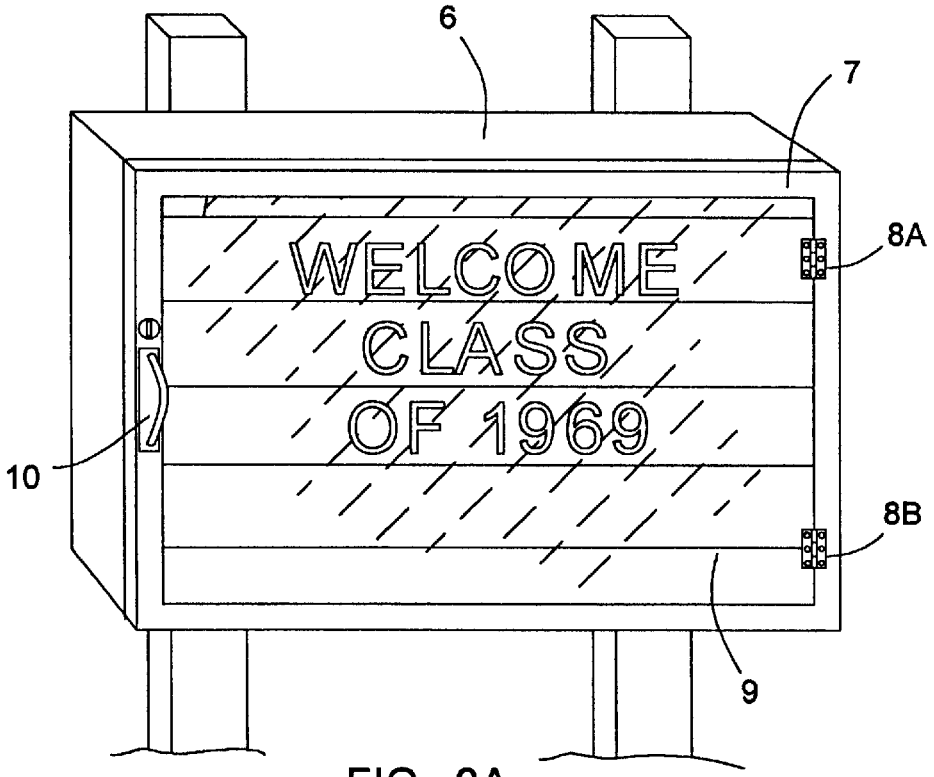
FIG. 2A (PRIOR ART)
FIG. 2A is a perspective view of a prior art signage system, in which a changeable signage system is physically encased within a cabinet having a transparent viewing window.

Referring to the figures, the illustrative embodiments of the present invention will be described in detail, wherein like elements shall be indicated with like reference numerals.

Figure 3:
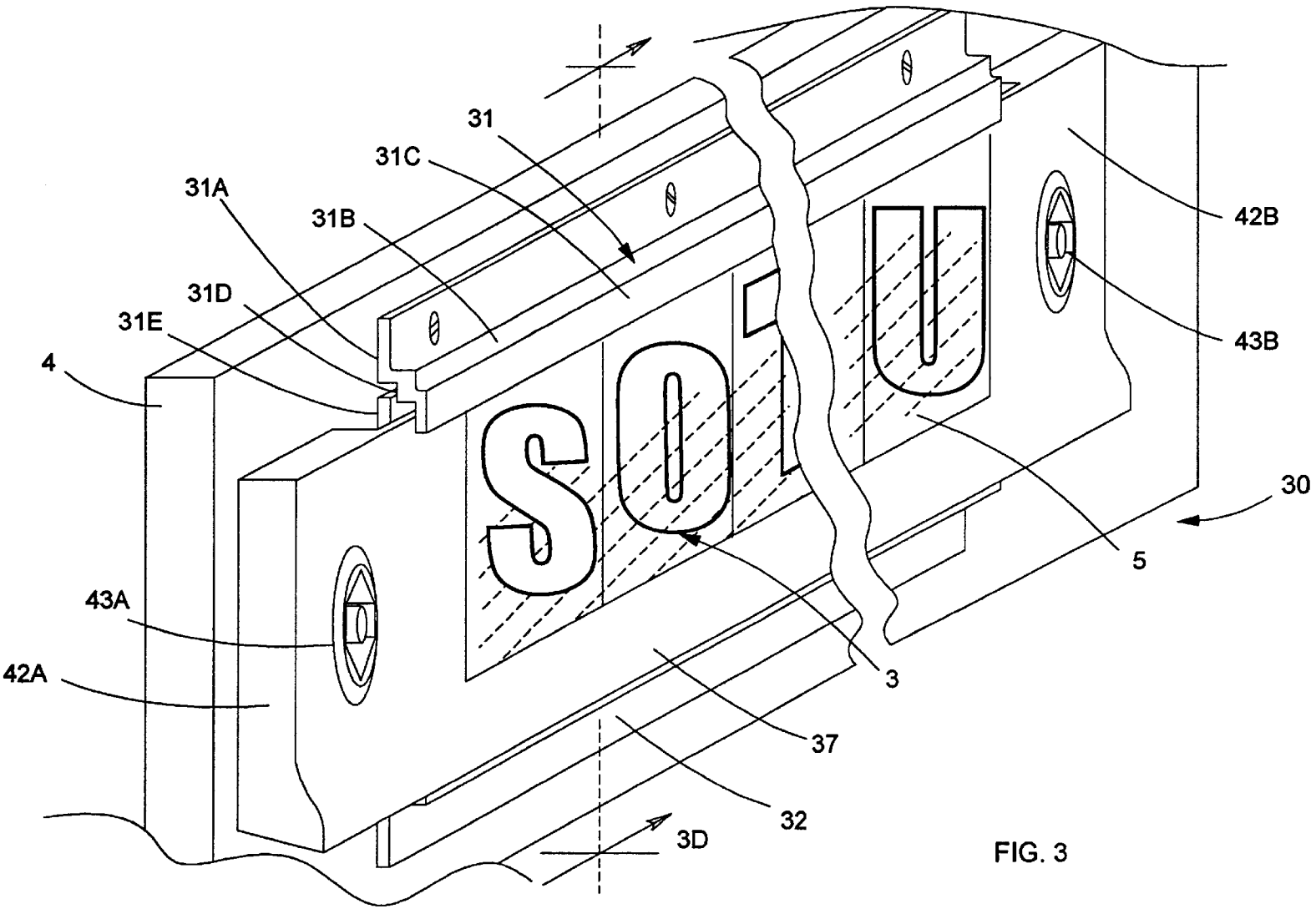
FIG. 3 is a perspective view of the changeable signage system of the first illustrative embodiment of the present invention.
Figures 3A, 3B, 3C:
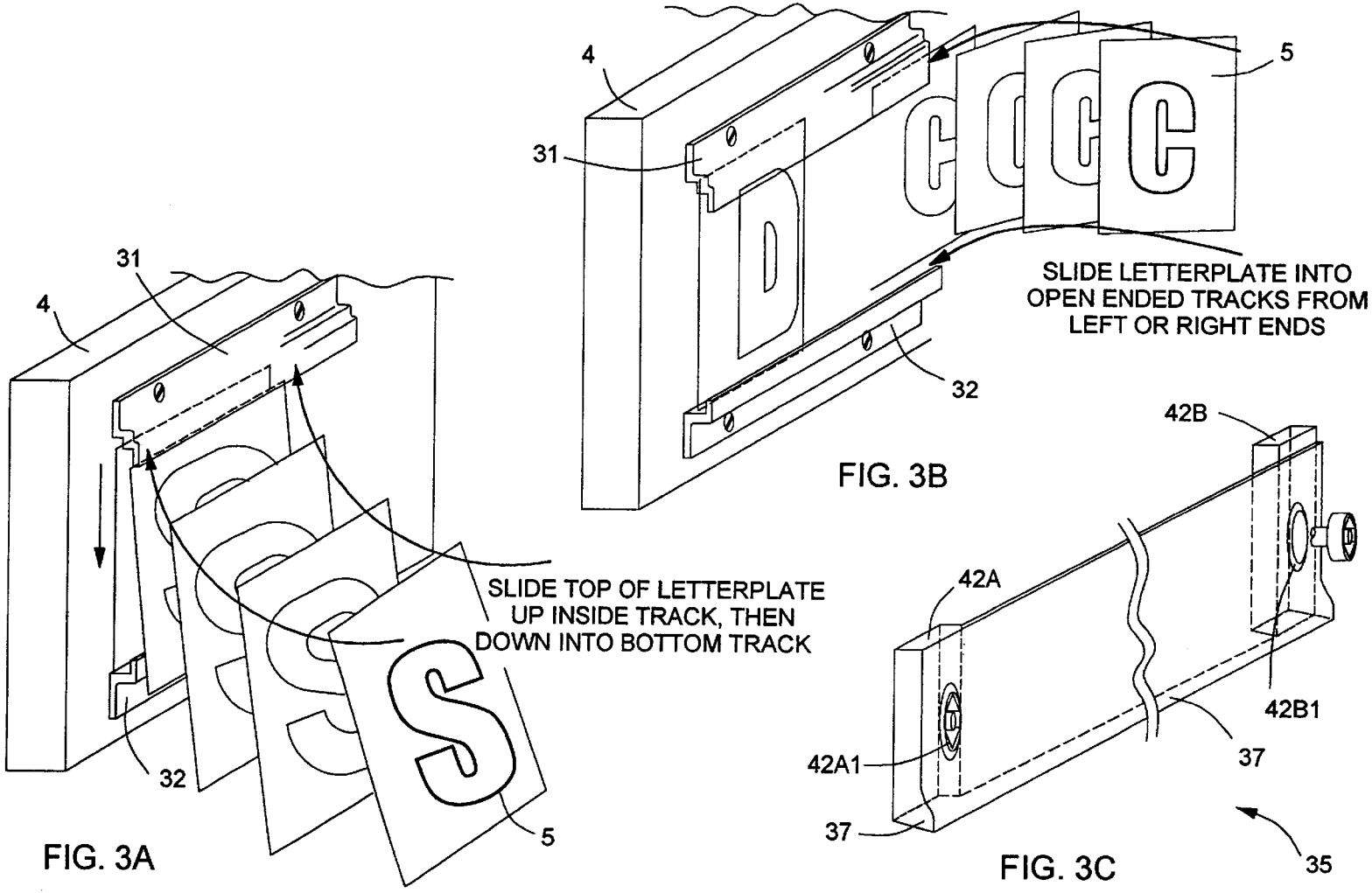
FIG. 3A illustrates a first method of inserting letters between the upper and lower character holding tracks thereof.
FIG. 3B is illustrates a second method of inserting letters between the upper and lower character holding tracks thereof.
FIG. 3C is a perspective view of the protective viewing window panel of the system shown in FIG. 3.
Figure 3D:
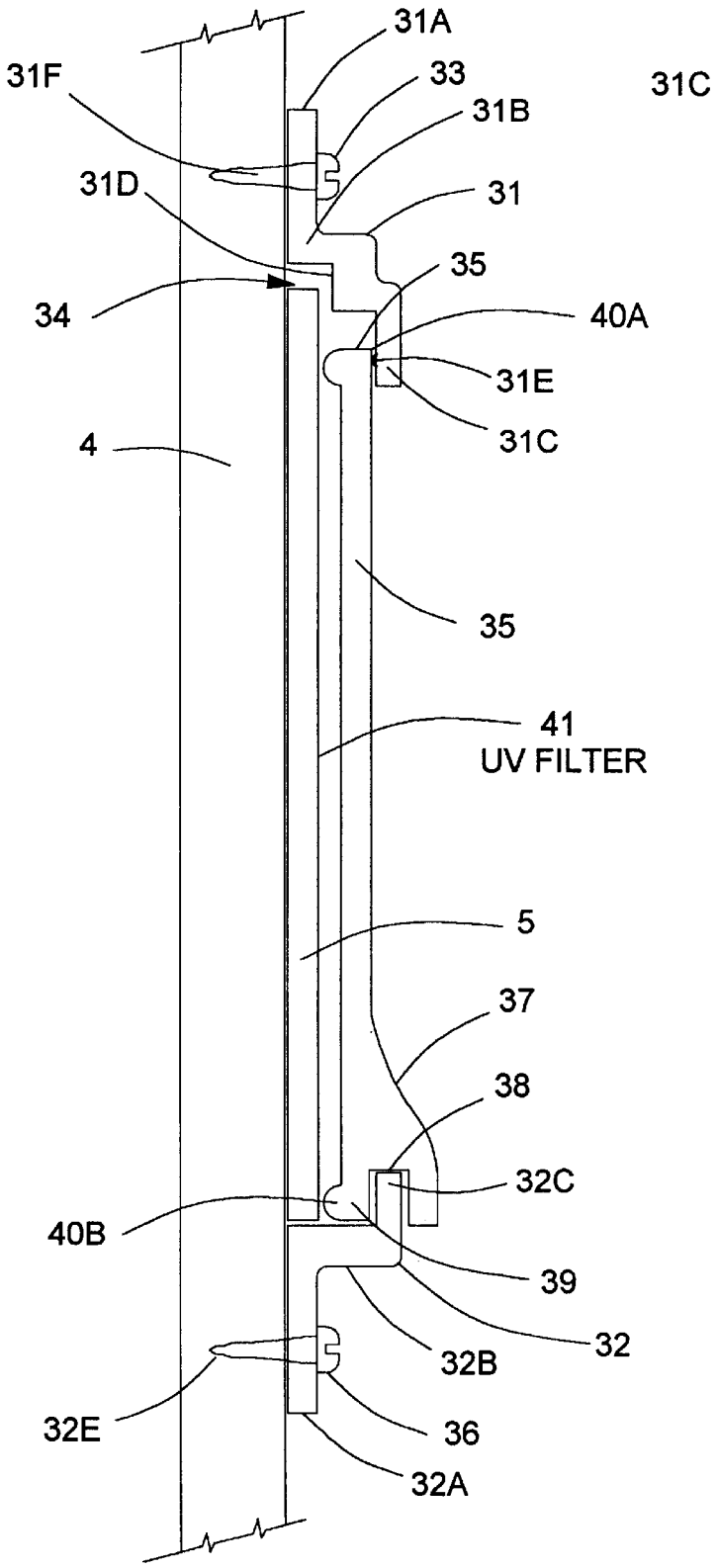
FIG. 3D is a cross-sectional view of the changeable signage system taken along line 3D—3D shown in FIG. 3, wherein the protective lip portion of the protective viewing panel is physically integrated the window (glazing) structure thereof.
Figure 4:
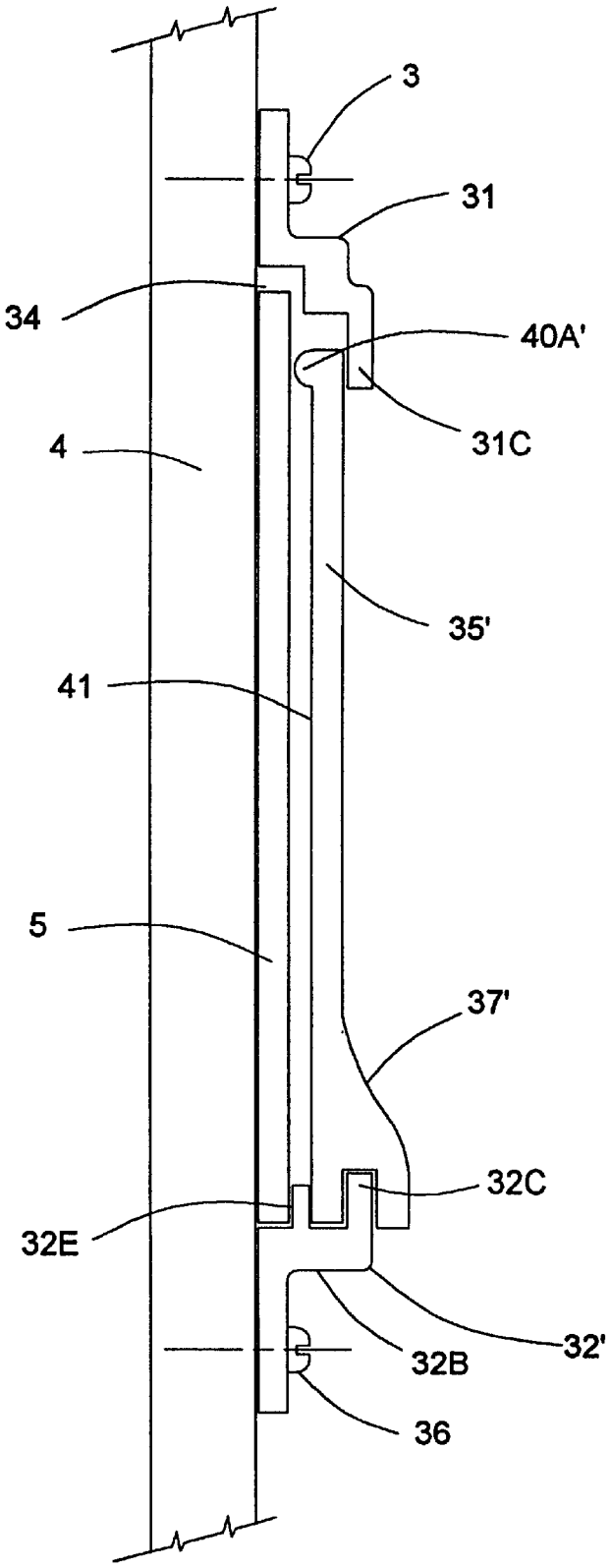
FIG. 4 is a cross-sectional view of the changeable signage system taken along line 3D—3D shown in FIG. 3, wherein the protective lip portion is realized as a separate element that is affixed to the optically transparent viewing panel of the system.

In FIGS. 3 through 3D, the changeable signage system of the first illustrative embodiment is shown. The changeable signage system of the second illustrative embodiment is shown in FIG. 4.

In FIG. 3, the readerboard (i.e. changeable character) signage system 30 of the present invention is shown, wherein a pair of upper and lower character holding tracks 31 and 32, spaced-apart and extending in a parallel manner along a sign board 4, hold a sequence of discrete characters 5 in place relative to each other. In general, each character 5 comprises a rectangular shaped substrate upon which a symbol, such as an alphanumeric character, is realized by printing, adhesive attachment, or other means. Each character can be made from opaque or optically transparent material, depending on whether backlighting is to be employed in the construction of the signage system.

As shown in FIGS. 3A and 3D, upper character holding track 31 has several portions integrally formed together, namely: a base portion 31A screwed or nailed to the signboard; a back portion 31B typically extending perpendicularly from the base portion 31A; and a flange portion 31C extending perpendicularly from the back portion 31B and having first and second channels 31D and 31E, respectively, formed in the flange portion 31C of the character holding track. The base portion of the upper holding track has two or more holes 31F formed therein for passage of fastening screws 33. When the upper track is nailed or screwed to the signboard, a first elongated space (i.e., track) 34 is formed beneath the flange portion and the front surface of the signboard opposite thereto for retaining the upper edges of the characters 5, and a second elongated space (i.e., track) 35 is formed beneath the flange portion and the front surface of the signboard opposite thereto for retaining the upper edge of the optically transparent protective-viewing panel 31, as shown in FIG. 3D.

As shown in FIGS. 3A and 3D, lower character holding track 32 has several portions integrally formed together, namely: a base portion 32A screwed or nailed to the signboard; a back portion 32B typically extending perpendicularly from the base portion 32A; and a flange portion 32C extending perpendicularly from the back portion 32B of the characacter holding track. The base portion of the lower holding track has two or more holes 32E formed therein for passage of fastening screws 36. When the lower track is nailed or screwed to the signboard, an elongated space (i.e. track) 34 is formed beneath the flange portion and the front surface of the signboard opposite thereto in order to retain the upper edges of the characters 5, and the lower edge of protective-viewing window 35, as shown in FIG. 3D.

In order to retain the upper edges of the characters between the upper character holding track and the front surface of the signboard, the second channel portion 31D of the upper track is spaced from the front surface of the signboard by a distance slightly greater than the width of the characters used to form messages in the system, as shown in FIG. 3D. In order to retain the upper edge of the protective-viewing panel 35 between the front surface of the characters and the first channel portion 31C, the first channel portion 31D of the upper track is spaced from the front surface of the loaded characters by a distance slightly greater than the width of the protective-viewing panel, as shown in FIG. 3D.

In order to retain the upper edge of the protective-viewing panel 35 and the lower edge of the loaded characters between the channel portion 32C of the lower character holding track, the channel portion 32C of the lower track is spaced from the front surface of the signboard by a distance slightly greater than the composite width of the viewing window and the characters used to formed the displayed message, as shown in FIG. 3D. Preferably, the upper and lower tracks are made from a flexible material designed to withstand outdoor temperatures and natural elements. In many applications, it will be desired, although not necessary, that the flange portions be optically transparent so that the entire character surface is rendered visible to viewers.

As shown in FIGS. 3 through 3D, the optically transparent character protective-viewing panel 35 of the first illustrative embodiment has unitary construction. As shown in FIGS. 3 and 3D, this character protective-viewing panel is installed over the character sequence loaded within the upper and lower character holding tracks secured to the signboard. Preferably, the character protective-viewing panel is made from an optically transparent material, such as plexiglass or like material, having high optical clarity.

As best shown in FIGS. 3C and 3D, the lower outer edge of the protective-viewing panel 35 has lip portion 37 which extends over flange portion 32C of the lower character holding track. Also, the lower bottom edge portion of the protective-viewing window 35 has a groove 38 formed therealong for receipt of the upper edge of the flange portion 32C, while bottom edge portion 39 of the panel is held within channel 32D between the front surface of the held characters and flange portion 32C of the lower track. The function of the lip portion 37 and groove 38 is to prevent natural elements such as rain, ice, snow, dirt, dust and grime from entering the channel portion 32D formed between flange 32C and the front surface of the signboard.

Preferably, low-relief type projections 40A and 40B are formed along the upper and lower edges of the back surface of the protective-viewing panel 31, as best shown in FIG. 3D. The function of these low-relief projections 40A and 40B is to provide a small gap between the back of the protective-viewing window 31 and the front surface of the characters held within the tracks. In the illustrative embodiment, an ultra-violet (UV) blocking film layer 41 is applied to rear surface of the protective-viewing window 31 in order to block UV solar radiation from striking the front surface of the characters held therebehind, as shown in FIG. 3D. Such UV radiation filtering protect the dyes and pigments and dyes used to color or otherwise enhance the light reflective properties of the signage characters.

As shown in FIGS. 3 and 3C, a first spacing structure 42A is provided on the back surface of one end of the character protective-viewing panel 31. The thickness of spacer 42 is equal to or slightly greater than the thickness of each character held within the tracks. Spacer 42 has at least one hole 42A1 formed therethrough for passage of a security screw 43A into the signboard 4 after the protective-viewing panel has been installed in place over the assembled characters. Spacing structure 42A can be realized as a thin plastic strip mounted to the end of the character locking-viewing panel with a suitable adhesive. Alternatively, it may be integrally formed as part of the protective viewing panel 31, or it may a separate element positioned in place after the viewing panel has been installed.

As shown in FIGS. 3 and 3C, a second spacing structure 42B is mounted behind the back surface of the other end of the character protective-viewing panel 31. The thickness of spacer 42B is equal to or slightly greater than the thickness of each character held within the tracks. Spacer 42B has at least one hole 42B1 formed therethrough for passage of a security screw 43B into the signboard 4 after the protective-viewing panel has been installed in place over the assembled characters. In the illustrative embodiment, spacing structure 42B can be realized as a thin plastic strip mounted behind the end of the character locking-viewing panel 31 after it has been installed over the message characters.

In FIG. 4, a second embodiment of the signage system of the present invention is shown. This system is similar in all respects to the system shown in FIGS. 3 through 3D, except that the lip portion 37 is realized as a separate structure from the panel 35 and is affixed thereto by cement, rivets or other fastening means known in the art. Also, instead of a low relief projection(s) 40B being formed as part of the panel, an additional flange 32E, extending perpendicularly from portion 32B of the lower track, can be formed in order to achieve a desired degree of spacing between the lower portion of the viewing panel and message characters. Also, instead of providing low relief projection(s) 40A, an ultra-thin plastic strip 40A' can be applied to the back portion of the panel in order to achieve a desired degree of spacing between the upper portion of the viewing panel and message characters.

In general, there are two methods for loading character sequences into the parallelly extending, character holding tracks, so that a message is displayed. These methods will be briefly described below.

As shown in FIG. 3A, the front-loading method involves sliding the upper end of each character underneath the ledge portion of the upper track, at the location where the letter is to be positioned. Then when the rear surface of the character is positioned against the front surface of the signboard, the lower portion of the character is lowered into the space provided between the flange portion of the upper track and the front surface of the signboard. This simple procedure is repeated for each character in the message to be displayed by the changeable signage system. When this method is used, the back portions of the upper and lower tracks must be spaced apart from each other a distance greater than the height of each character by an amount equal to the length of the ledge portion of the upper character holding track.

As shown in FIG. 3B, the end-loading method involves sliding each character beneath the flange portions of the upper end lower tracks, at one end of the character holding track assembly. When using this technique, the upper and lower tracks can be spaced apart a distance slightly greater than the height of each character in the system.

After a configured character string is loaded within the tracks using either of the methods described above, the character protective-viewing panel 31 is slid within track 35 formed between the loaded characters and flanges 31C and 32C, with the end associated with spacer 42B being inserted first. When the viewing panel has been slid completely over the message characters, and the spacer structure 42A is aligned with the end of the tracks, as shown in FIG. 3, security screw 43A is passed through hole 42A1 and screwed into the signboard, as shown. Therafter, spacer portion 42B is positioned under the end of opposite end of the viewing panel and security screw 43B is passed through hole 42B1 and into the signboard.

When the character protective-viewing panel has been installed over the assembled string of characters 5 and secured to the signboard in the manner described above, casual removal or mischievous reorganization of the characters cannot occur without destroying the character holding tracks and/or the character locking viewing panel. In addition to locking the loaded characters into the tracks, the character protective-viewing panel of the present invention protects the underlying characters from vandalism (e.g. graffiti), such a spray painting and/or vandalism without the need to contain the entire signage system within a free-standing viewing enclosure (i.e box) which is both very expensive to construct and significantly detracts from the overall appearance of the signage system. In the event that graffiti is writing upon the character protective-viewing panel, such writing can be easily removed with solvents, without effecting the underlying characters.

In the assembled configuration shown in FIG. 3, the lip portion 37 and groove 38 of the viewing panel 31 prevents natural elements such as rain, ice, snow, dirt, dust and grime from entering the channel portion 32D formed between flange 32C and the front surface of the signboard. By preventing such elements from entering the lower channel 32D, the author of the displayed message can easily remove the protective-viewing panel and change the message as desired at any time during the year. In the cold winter months, the lip portion prevents ice and snow from accumulating in the lower channel, thus making it significantly easier to remove the panel and thus characters therebehind for routine message changing operations.

While the signboard shown in the illustrative embodiments of the present invention has been presented as opaque for illustrative purposes, it is understood that an illuminated (i.e. backlit) signboard structure can be used with the signage system of the present invention. In such alternative embodiments, the characters will be realized using transparent substrates and opaque graphics to block light rays where characters are to be formed along the signage surface.

While several illustrative embodiments of the present invention have been disclosed hereinabove, it is understood that numerous modifications and variations of these embodiments will occur to those with ordinary skill in the art. All such modifications and variations shall be deemed to fall within the scope and spirit of the present invention defined by the appended Claims to Invention.

What is claimed is:

1. A whether-proof changeable-type readerboard signage system, comprising:

a signboard having a substantially planar surface;

a pair of upper and lower character holding tracks, each being attached to the substantially planar surface of said signboard and extending in a parallel manner relative to each other by a predetermined distance;

a plurality of character substrates of rectangular geometry, each said character substrate bearing a graphical character and having a height dimension slightly less than said predetermined distance so as to be front loadable into said pair of upper and lower character holding tracks, and releasably retained therewithin so as to form a string of characters displaying a readable message; and a character-protective viewing panel of optically transparent construction, slidably retained within said upper and lower character holding tracks in conjunction with said plurality of character substrates, so that said character-protective viewing panel is physically disposed over said plurality of character substrates and releasably secured to said signboard by one or more fastening elements passed through said character-protective viewing panel and into said signboard so as to prevent unauthorized removal of said character substrates from said upper and lower character holding tracks, while protecting said character substrates against mischief and vandalism, and natural elements presented in outdoor environments.

2. The weather-proof changeable-type readerboard signage system of claim 1, comprising:

a signboard having a substantially planar surface, and wherein said signboard being supportable above the Earth's surface at a predetermined viewing height.

3. The weather-proof changeable-type readerboard signage system of claim 1, wherein said signboard is made from wood type material, and said character-protective viewing panel is made of optically transparent plastic material.

4. The weather-proof changeable-type readerboard signage system of claim 1, wherein said fastening elements comprise security-type screws.

* * * * *